United States Patent [19]

Grazia

[11] Patent Number: 4,628,973

[45] Date of Patent: Dec. 16, 1986

[54] APPARATUS FOR SUPPLYING VOLUMETRIC METERING DEVICES, PARTICULARLY FOR MACHINES FOR PACKAGING INFUSION PRODUCTS

[75] Inventor: Alessandro Grazia, Crevalcore, Italy

[73] Assignee: IMA-Industria Macchine Automatiche-SpA, Ozzano Emilia, Italy

[21] Appl. No.: 675,964

[22] Filed: Nov. 28, 1984

[30] Foreign Application Priority Data

Nov. 28, 1983 [IT] Italy ..... 3640/A83

[51] Int. Cl.[4] ..... B65B 1/16

[52] U.S. Cl. ..... 141/94; 141/98; 141/129; 141/44; 222/476

[58] Field of Search ..... 141/94, 83, 81, 98, 141/1, 67, 8, 11, 12, 69, 129, 144, 249, 250, 255, 256, 259, 392, 261, 37, 39, 44, 45; 366/56, 154, 173, 182, 192; 53/266 R; 222/476

[56] References Cited

U.S. PATENT DOCUMENTS 3,353,722 11/1967 Mehta ..... 141/144

3,656,517 4/1972 Taylor et al. ..... 141/1

4,344,823 8/1982 Stratmann et al. ..... 141/94

4,433,798 2/1984 Romagnoli ..... 222/255

*Primary Examiner*—Stephen Marcus

*Assistant Examiner*—Ernest G. Cusick

*Attorney, Agent, or Firm*—Karl F. Ross; Herbert Dubno

[57] ABSTRACT

An apparatus for supplying volumetric metering devices especially for machines for packaging infusion products, in which the metering devices are of the type having a metering chamber within which a metering drum rotates in a discontinuous manner. The apparatus comprises a fixed hollow body facing the body of the metering device and provided with a vertical supply duct for the product to be metered, a frustoconical hollow body in the shape of a funnel rotating in an inclined manner in the fixed hollow body, with its upper, wider opening below the supply duct and with its lower, smaller opening communicating with the metering chamber in the vicinity of the metering drum, a shutter for regulating the flow of the product along the lower internal surface of the rotary funnel-shaped hollow body at least in the vicinity of its lower smaller opening, and variable speed gearing controlled by the drive means of the packaging machine so as to rotate the funnel-shaped body about its own inclined axis.

2 Claims, 3 Drawing Figures

30
29
32
33
22a
21C
21
A
21a
22
25
37
12b
18
20
21d
16
12F
21b
19
33
16b
9
35
28
27
36
24
12d
12a
21e
36
13
33
14
6
38
12e
12
15
17
16C
12C
5C
5b
16a
5a
7
8a
8
5a
6a
32
30
31
34

APPARATUS FOR SUPPLYING VOLUMETRIC METERING DEVICES, PARTICULARLY FOR MACHINES FOR PACKAGING INFUSION PRODUCTS

FIELD OF THE INVENTION

The present invention relates to an apparatus for supplying volumetric metering devices, particularly for machines for packaging infusion products.

BACKGROUND OF THE INVENTION

In practice it has been observed that loose infusion products to be supplied to the volumetric metering devices of machines for packaging these products such as mint, mallow, lime and the like, give rise to various drawbacks during the metering stage as they form bridges along the duct for their supply to the metering chamber of these volumetric devices, thereby preventing metering of some portions and in some cases even failing to advance any portion at all with the consequent stoppage. and therefore the loss of production with a consequent waste of time and packaging material.

OBJECT OF THE INVENTION

The main object of the present invention is to provide apparatus for supplying volumetric devices, particularly in the case of machines for packaging infusion products which avoids these drawbacks completely.

A further object of the present invention is to achieve the above aim by means of a supply apparatus construction for the above-mentioned purpose, which is very simple and economical in relation to the results which may be achieved therewith in practice.

SUMMARY OF THE INVENTION

These and other objects dealt with below are all achieved with the apparatus of the present invention for supplying volumetric metering devices, in particular for machines for packaging loose infusion products, these metering devices being of the type having a metering chamber in which a metering drum rotates discontinuously. The apparatus comprises a fixed hollow body facing the body of the metering device, a frustoconical hollow body having a funnel shape supported obliquely and rotatable within the fixed hollow body with its lower smaller opening communicating with the metering chamber in the vicinity of the said metering drum, and a supply duct for the loose product to be metered supported vertically by the said fixed hollow body and communicating with the rotary frustoconical hollow body having a funnel shape in the area of its upper wider opening.

Shutter means can be supported by the fixed hollow body and designed to regulate the flow of the loose product to be metered along the lower internal surface of the said rotary frustoconical hollow body having the shape of a funnel at least in the vicinity of its lower smaller opening communicating with the metering chamber, and variable speed gearing means designed to drive the funnel-shaped, frustoconical hollow body to rotate about its inclined axis, the said variable speed gearing and drive means being controlled by the drive means of the packaging machine.

BRIEF DESCRIPTION OF THE DRAWING

Further characteristic features and advantages of the apparatus of the invention are shown in the following detailed description of a preferred embodiment, given purely by way of non-limiting example, with reference to the attached drawing, in which.

Figure 1:
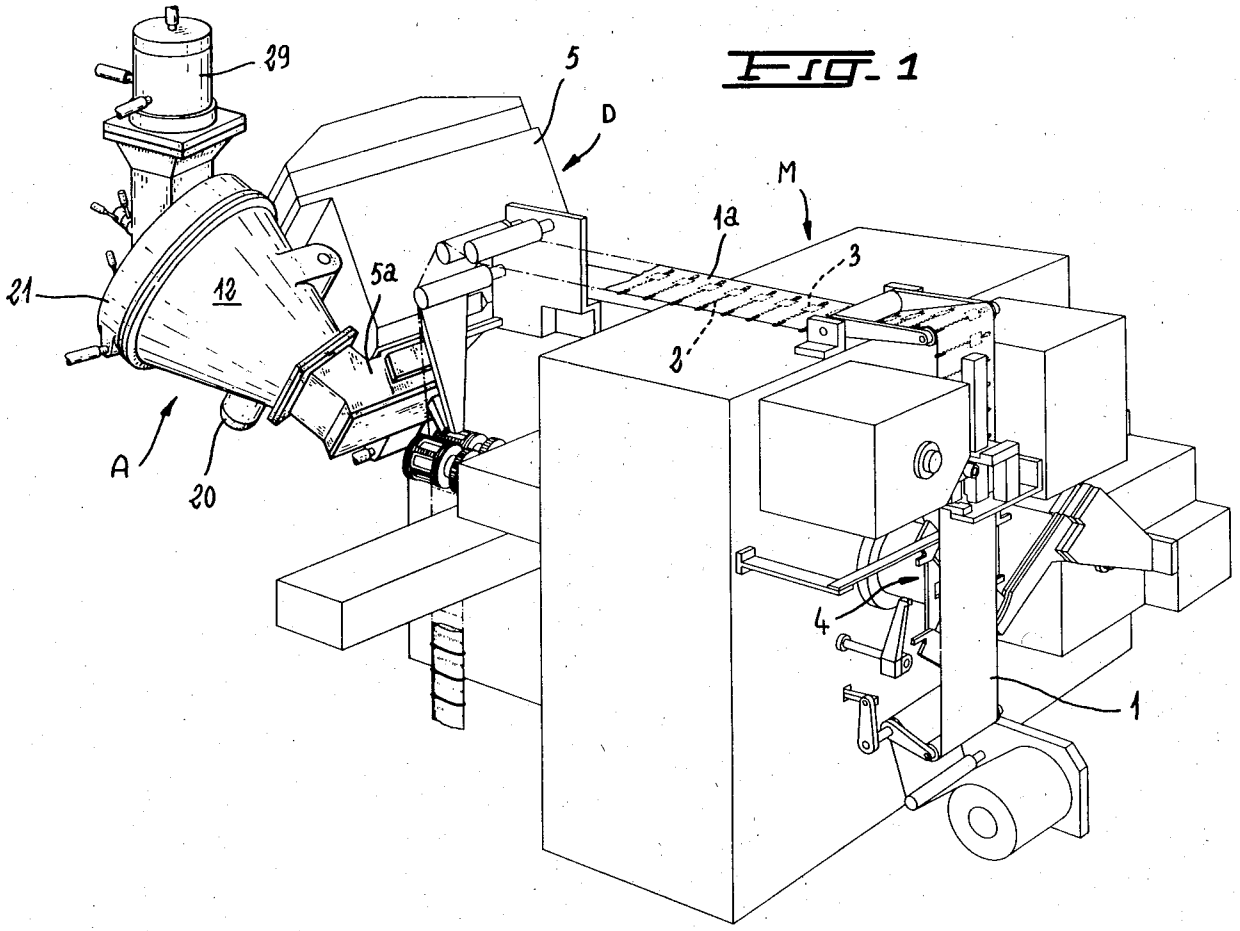
FIG. 1 is a front perspective view of a packaging machine having a high production speed for sachets of filter paper for infusion products with which there is associated the apparatus of the invention, shown in darker lines.
Figure 2:
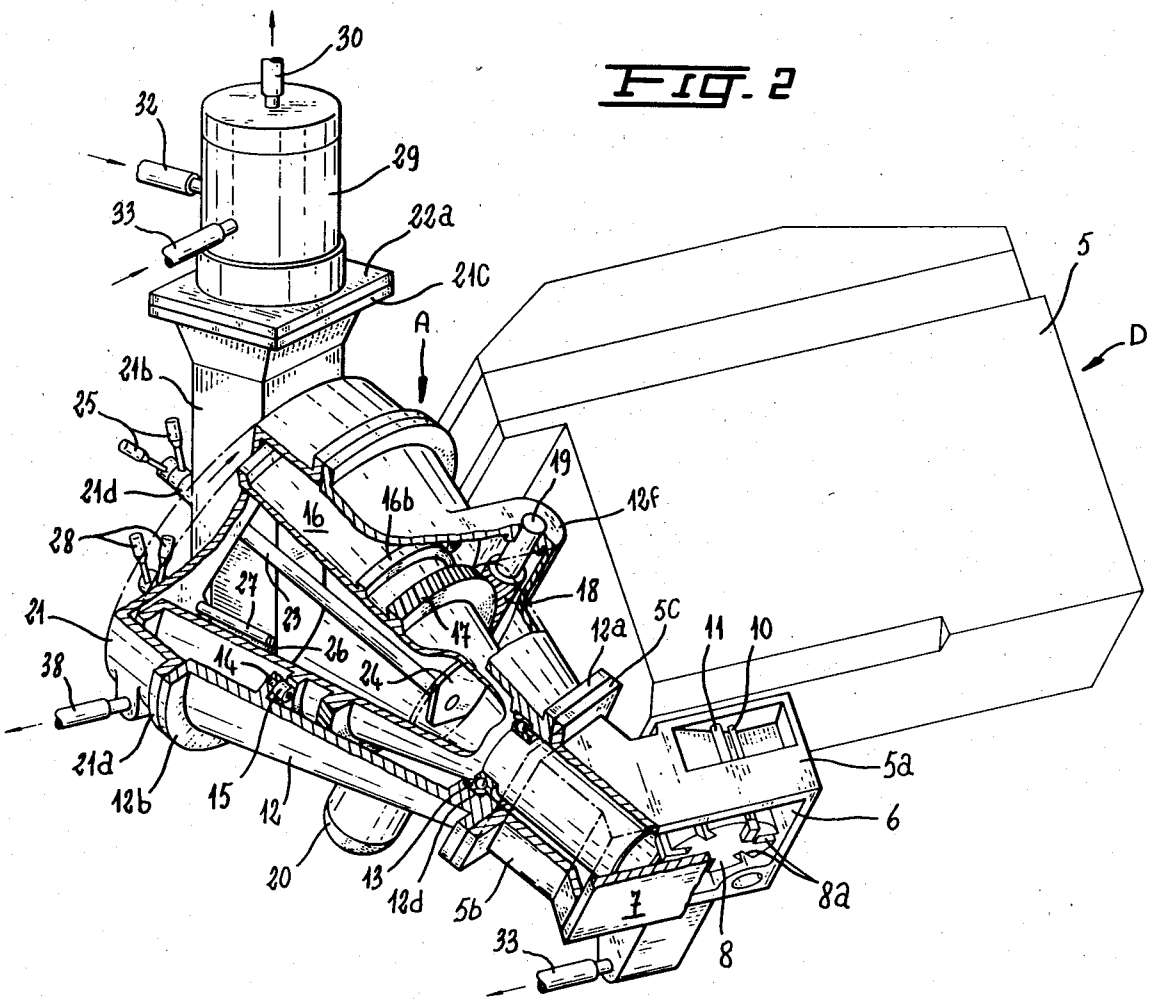
FIG. 2 is a perspective view, on an enlarged scale, of the same apparatus, showing some portions in cross-section and having some portions removed in order to provide an improved view of others.

The packaging machine M shown in FIG. 1, with which there is associated by way of example the supply apparatus A of the present invention, is of the type produced and sold by the applicants under the trademark IMA C 55 (see U.S. Pat. No. 4,288,224 and 4,382,355), having a production capacity of approximately 500 filter paper sachets per minute. The machine forms these sachets of filter paper from a strip of filter paper 1 provided on its surface with a light layer of thermoplastic material, transversely to which sections of suspension thread 2 made from natural fibers with a label 3 attached thereto are attached with a uniform spacing. The strip 1 is caused to pass in front of a head or wheel 4 having radial arms which may be rotated discontinuously by the packaging machine and which also comprises means for supplying a continuous thread to this head or wheel having radial arms rotating in a discontinuous manner. A device supplying labels and means is provided for attaching these labels with a uniform spacing to the continuous thread of natural fibers upstream of the rotary head or wheel such that the continuous thread which is caused to move by the said rotary head or wheel with a label attached at each of its arms is caused to pass through work stations in which the thread is firstly cut downstream of the label, then folded parallel to itself and then attached to the strip for the localized impregnation of the thread of natural fiber with the thermoplastic material of the coating layer of the strip which diffuses through the filter paper following the action of heating and pressure means.

Downstream of the rotary head 4 there is therefore provided a strip of filter paper 1*a* provided, with a uniform spacing, with sections of thread 2 to which a label 3 is attached.

The formation of the sachets from a strip provided in this way with portions of suspension thread 2 with a label 3 attached thereto, takes place by the folding the paper in half longitudinally, in the first instance, and then joining it transversely so as to form sachets which are open on one side so as to enable the introduction of the amounts of product and finally by closing and separating the sachets obtained in this way.

The introduction of the doses of product into the sachets which are open on one side is carried out using the volumetric metering device disclosed in the Italian Patent Application No. 3314 A/81 of Jan. 23, 1981, corresponding to U.S. Pat. No. 4,433,798 which enables the achievement of the production capacity of these packaging machines which is, as mentioned above, approximately 500 filter paper sachets per minute, using a particular structure for the formation and removal of the doses by pressure action.

Figure 3:
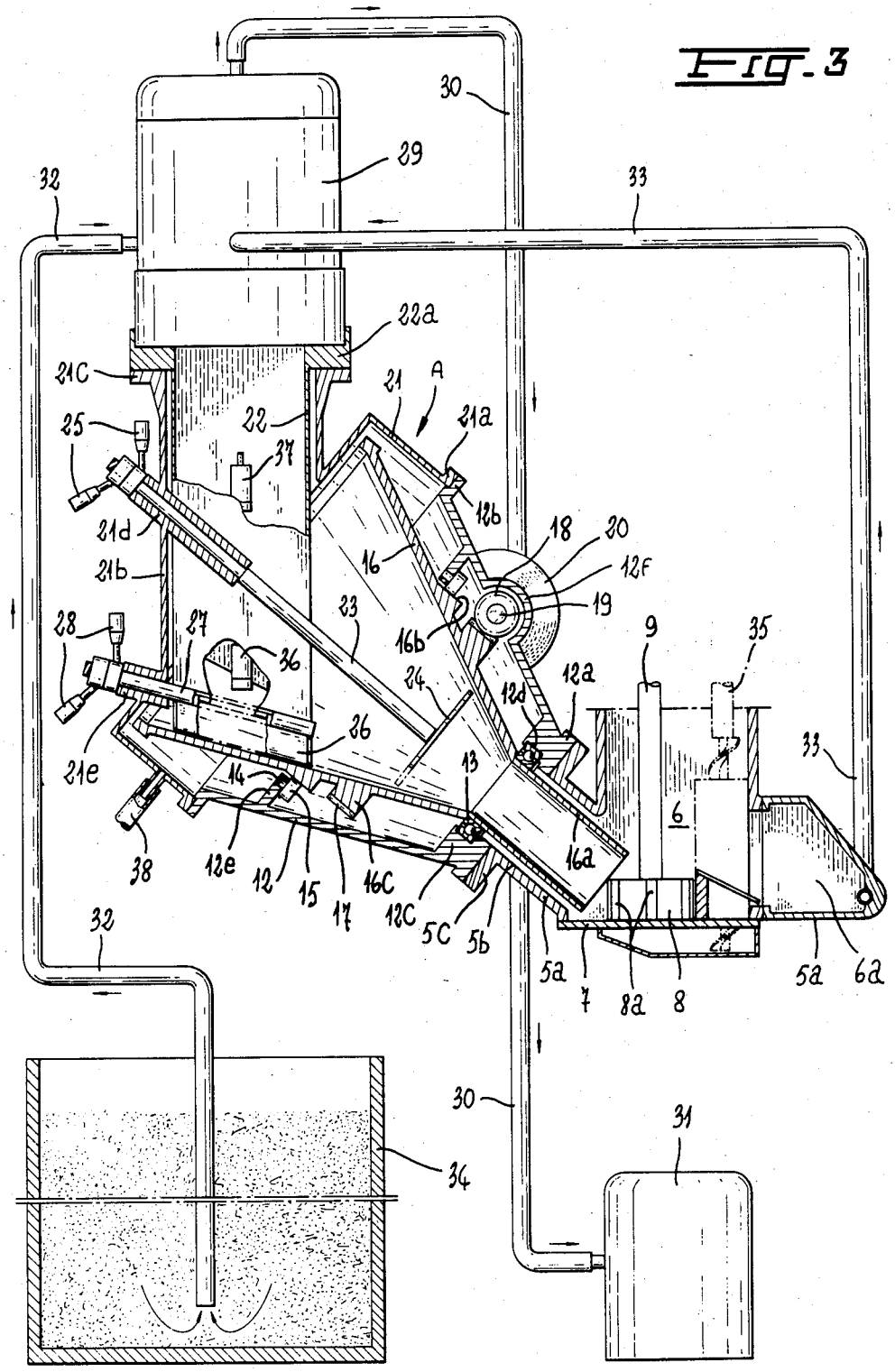
FIG. 3 shows the same apparatus in partial cross-section along a median plane.

Substantially as disclosed in this patent, the volumetric metering device, shown overall by D, comprises a body 5 provided in its lower portion 5*a* with a space 6 designed to communicate, via a duct section 5*b* of this lower portion 5*a* of the body 5, with a supply duct for the loose product to be metered and packaged. Inside the space 6, in the vicinity of its base which is defined by a base plate 7, there is housed a rotary metering drum 8 provided peripherally with a plurality of metering cavities or chambers 8*a* with a uniform spacing in the form of through chambers which are open radially, and a spindle 9 projecting from the space 6 (see FIG. 3 in particular) so that it may be discontinuously actuated and with which there cooperates a means 10 for the formation of the doses and a means 11 for the removal of these doses operating by pressure action.

The supply apparatus A of the present invention is associated with the said duct section 5*b* via its hollow or main body 12.

The supply apparatus A comprises the hollow body 12 having a frustoconical shape with its opposite ends, the lower end having a smaller diameter than the upper end, flanged as shown at 12*a* and 12*b* respectively. The said hollow, frustoconical body 12 is fixed, via its flanged portion 12*a*, using any known method, to the flange 5*c* provided on the duct section 5*b* of the lower portion 5*a* of the volumetric metering device D, in such a way that its axis is inclined with its end of greater diameter facing upwards. The hollow, frustoconical body 12 has in its lower inner portion a thicker portion 12*c* in which there is provided a seat 12*d* for housing a ball bearing 13 while in the vicinity of its upper inner end portion it has a plurality of projections (three) 12*e* which are uniformly spaced and which each support a fixed pin 14 in which there is mounted an idler wheel or bearing 15.

A funnel-shaped frustoconical hollow body 16 is mounted coaxially to rotate within the frustoconical body 12 such that its lower section 16*a* is engaged on the ball bearing 13 and such that it is supported by its intermediate tracked thicker section 16*b* against the said rolls or bearings 15.

Between this lower section 16*a* and the intermediate tracked thicker section 16*b*, the said funnel-shaped frustoconical hollow body 16 has an annular thicker section 16*c* having external toothing in the shape of a helical wheel 17 in whose oblique teeth there engages the endless screw 18 keyed on the drive shaft 19 of a variable speed gearing 20 supported by a projection 12*f* provided on the outside of the body 12. The variable speed gearing is controlled by the drive motor of the packaging machine.

The lower section 16*a* of the funnel-shaped frustoconical body 16 extends into the metering space or chamber 6 to the region of the rotary metering drum 8, while the opposite end, having a greater diameter, of this funnel-shaped body 16 extends beyond the flanged end 12*b* of the body 12. This flanged end 12*b* of the body 12 is fixed, in any known manner, to a cover member 21 by means of its flanged edge 21*a*. The cover member 21 extends vertically upwardly by means of a tubular section 21*b* which is terminated at the top by a flange 21*c* to which there is connected, again using means of any known type, the flanged portion 22*a* of a duct element 22 projecting downwardly within the the tubular section 21*b* of the cover member 21, until it reaches the area of the lower internal surface of the funnel-shaped frustoconical body 16 (see FIG. 3 in particular).

The said tubular section 21*b* of the cover member 21, in the external position with respect to the duct element 22 has an inclined boss 21*d* which supports in a rotary manner the spindle 23 of a disc shutter device 24 disposed in the vicinity of the lower section 16*a* of the funnel-shaped body 16. This disc shutter device 24 is designed, by means of the rotation of the spindle 23, to regulate the flow towards the the lower section 16*a* of the funnel-shaped body 16 along the lower internal surface of this body 16, as will be shown below. The locking in the regulated position and the associated unlocking of this disc shutter device 24 is carried out by acting on the boss levers 25 which may be screwed and unscrewed on the threaded end of the spindle 23, externally to the boss 21*d* of the vertical tubular section 21*b* of the cover member 21.

The interior of the duct element 22 is provided in its lower portion with a second shutter device constituted by a plate 26 carried in a raised manner by a spindle 27 supported in a rotary manner by a boss 21*e* of the cover member 21 which may be locked and unlocked in the regulation position of its associated plate 26 by boss levers 28 which may be screwed and unscrewed on the threaded end of the spindle 27 externally to the boss 21*e*.

A hollow body or low pressure drum 29 is fixed in any known manner to the flange 22*a* of the vertical duct element 22, in the upper portion of which body one end of a suction duct 30 is located, the other end of this duct leading to a suction means 31 of any known, commercially available type. One end each of two suction ducts 32 and 33 lead to the inside of this hollow body or low pressure drum at its lateral surface, the other ends of the ducts 32 being immersed in the infusion product to be supplied contained in a container 34. The opposite end of duct 33 runs the lower portion 5*a* of the body 5 of the volumetric metering device D the duct 33 communicating with the metering chamber 6 inside of which there is provided, in addition to the metering drum 8, a seat for a rotary screw 35 designed to lift and discharge excess product within the said metering chamber 6 as set out in the aforementioned patent.

Within the duct element 22 there are provided two sensors of known type for the level of the infusion product to be supplied, i.e. a sensor 36 for the minimum level of the product and a sensor 37 for the maximum level of the product to be supplied. These lower 36 and upper 37 sensors control the suction means 31 for drawing the product via the duct 32 into the hollow body or drum 29 and therefore into the duct element 22 from the container 34. Similarly excess from the metering chamber 6 is drawn by duct 32 into the drum 29. Finally, the cover member 21 is connected to a suction conduit 38 designed to maintain the interspace between the fixed body 12 and cover 21 of the apparatus and the rotary funnel-shaped body 16 free from possible product residues.

The operation of the supply apparatus of the present invention as described above is very simple and takes place as follows:

The variable speed gearing 20 which causes the rotation of the funnel-shaped body 16 is controlled by the drive motor of the packaging machine and its speed of rotation may be automatically adjusted as a function of the type of product to be metered and the amount of product to be supplied to the rotating member 16. The sensors 36 and 37 for the maximum and minimum level controlling the suction means 31 maintain the level of the product to be metered within the duct element 22, by regulation of the shutters 26 and 24 in the manner described above. The product then flows within the funnel-shaped body 16, which, by rotating, prevents the product from bridging such that it reaches with a uniform flow the metering chamber 6 where it is uniformly metered in the manner described in the abovementioned patent.

In practice, the particular construction of the supply apparatus described above may be widely varied overall within the scope of the following claims, while obviously retaining the concept of the invention which lies essentially in the construction and arrangement of the frustoconical funnel-shaped body, substantially as described above and claimed below.

I claim:

1. An apparatus for supplying a metering device of a packaging machine with loose infusion product, the metering device having a metering chamber in which a metering drum rotates, which comprises:

a hollow fixed body facing inclined downwardly toward the metering device;

a hollow, funnel-shaped, frustoconical body supported for rotation within the fixed hollow body about an axis which is inclined downwardly and toward said chamber, said frustoconical body having a lower aperture smaller than an upper aperture and communicating with the metering chamber proximal to the metering drum;

a supply duct for the loose product to be metered supported vertically by the said hollow fixed body, in communication with the said hollow funnel-shaped frustoconical body in the region of its upper aperture;

shutter means supported by the hollow fixed body for the regulation of flow of the loose product to be metered along a lower inner surface of said hollow funnel-shaped frustoconical body at least in a region of its lower aperture communicating with the said metering chamber; and variable speed gearing means for rotating said hollow, funnel-shaped, frustoconical body about said axis.

2. An apparatus as claimed in claim 1 wherein said supply duct supported by the fixed body extends downwardly into a region of the lower inner surface of the funnel-shaped frustoconical hollow body, said shutter means including an adjustable shutter at a lower end of said duct, sensors being provided along the interior of said duct for the maximum and minimum level controlling a suction means leading to a hollow body supported upon said duct, and wherein two suction ducts also lead to this hollow body, one of said suction ducts being immersed in the infusion product to be supplied contained in a container, the other of said suction ducts communicating with the metering chamber to recycle excess product to said hollow body supported upon the supply duct.

* * * * *